United States Patent [19]

Jefferies

[11] Patent Number: 4,577,992

[45] Date of Patent: Mar. 25, 1986

[54] SNOWPLOWABLE ROAD MARKER APPARATUS

[76] Inventor: George S. Jefferies, 413 Nassau Ave., Freeport, N.Y. 11520

[21] Appl. No.: 645,874

[22] Filed: Aug. 31, 1984

[51] Int. Cl.[4] ..... E01F 9/06

[52] U.S. Cl. ..... 404/16; 404/72; 116/63 R

[58] Field of Search ..... 404/6, 9, 14–16, 404/72, 73; 116/63 R; D10/113; 52/297, 298, 103

[56] References Cited

U.S. PATENT DOCUMENTS

| | | | |
|---|---|---|---|
| D. 113,298 | 2/1939 | Wise | D10/113 |
| D. 190,210 | 4/1961 | Angier | D10/113 |
| D. 190,606 | 6/1961 | Angier | D10/113 |
| D. 207,038 | 2/1967 | Haley | D10/113 |
| D. 215,376 | 9/1969 | Haley | D10/113 |
| D. 225,087 | 11/1972 | Haley | D10/113 |
| D. 243,515 | 3/1977 | King | D10/113 |
| D. 266,060 | 9/1982 | Beretta | D10/113 |
| D. 266,554 | 10/1982 | Beretta | D10/113 |
| D. 266,910 | 11/1982 | Brickwood | D10/113 |
| D. 270,143 | 8/1983 | Flanagan | D10/113 |
| 1,545,009 | 7/1925 | Paine | 404/16 |
| 1,896,920 | 2/1933 | Shapiro | D10/113 |
| 2,181,613 | 11/1939 | Stewart et al. | 404/16 |
| 2,260,498 | 10/1941 | Wise | 404/16 |
| 3,396,639 | 8/1968 | Lemelson | 404/14 X |
| 3,485,148 | 12/1969 | Heenan | 404/12 |
| 3,499,371 | 3/1970 | Jonnes et al. | 404/9 |
| 3,516,337 | 6/1970 | Gubela | 404/16 X |
| 3,587,416 | 6/1971 | Flanagan | 404/9 |
| 3,693,511 | 9/1972 | Medynski | 404/16 X |
| 3,836,275 | 9/1974 | Finch | 404/13 |
| 3,938,903 | 2/1976 | Montgomery | 404/16 |
| 3,975,108 | 8/1976 | Suhr et al. | 404/16 |
| 3,980,410 | 9/1976 | Suhr et al. | 404/16 |
| 4,088,416 | 5/1978 | Taylor | 404/16 |
| 4,147,447 | 4/1979 | Heenan et al. | 404/16 |
| 4,155,666 | 5/1979 | Flanagan | 404/16 |
| 4,195,945 | 4/1980 | Heenan | 404/16 |
| 4,402,628 | 9/1983 | Grenier et al. | 404/16 |

OTHER PUBLICATIONS

Brochure entitled "Stimsonite ® Life-Lite 96 Plowable Pavement Marker."

*Primary Examiner*—Stephen J. Novosad
*Assistant Examiner*—John F. Letchford
*Attorney, Agent, or Firm*—Wayne M. Kennard

[57] ABSTRACT

The present invention is a reflective snowplowable road marker (1) of unitary construction for disposition in a road surface without adhesive having an outwardly dished top section (4) with a relieved channel (8) extending across the top surface (5) of the top section (4) with the channel (8) being adapted to receive therein a reflector (6), and a bottom section (10) disposed from the bottom surface (22) of the top section (4) which has a cylindrical shape and a plurality of spaced apart gripping means (14) disposed on the outside surface of the bottom section (10).

19 Claims, 4 Drawing Figures

SNOWPLOWABLE ROAD MARKER APPARATUS

TECHNICAL FIELD

The present invention relates to the field of reflective road marker apparatus. The present invention more specifically relates to reflective snowplowable road marker apparatus.

BACKGROUND ART

Reflective road markers have been employed on roads to indicate the position of the centerline and sides of a road. These markers aid drivers in distinguishing the driving surface of the road at night and in inclement weather.

There has not been any particular problems associated with the installation and use of road markers in regions that have a mild climate having normally little or no snowfall during the year. However, problems do arise in regions that have enough snowfall that require the use of snowplows to remove the snow. In removing the snow from the roads with snowplows, conventional road markers are themselves damaged or the reflective lens of the road markers are frequently broken or damaged. This creates fiscal and labor problems in replacing the reflective lens, if not the entire road marker, after every snow season.

To remedy this problem, snowplowable road markers were used in the regions having enough snow that snowplows were required for the removal of the snow. These road markers generally had a low cross-sectional profile above the road surface to allow the snowplow blade to pass up and over the road marker without damaging the reflective lens element or the road marker.

The prior art discloses reflective snowplowable road markers having various shapes and configurations. However, in almost all cases these prior art road markers are secured to the road surface by a conventional all-weather adhesive, usually having an epoxy base.

Most prior art road markers which are snowplowable have recessed reflectors to prevent their damage as the snowplow passes up and over the road marker. Prior art reflective road markers of this type that are secured directly to road surface with adhesive are disclosed in U.S. Pat. Nos. 3,938,903 and 3,499,371. These apparatus have special configurations on the bottom surface of the road marker to aid in securing the apparatus to the road surface with adhesive. Examples of other road markers which have recessed reflectors and secured directly to the surface of the roadway with adhesive which do not have special configurations on the bottom of the road markers are shown in U.S. Pat. Nos. Des. 225,087 and Des. 207,038.

The prior art also discloses reflective snowplowable road markers with recessed reflectors which have a portion of the body of marker that extends into the road material. The portions of the road markers that do extend into the road material are immersed into adhesive disposed in the opening in road to receive these portions. In U.S. Pat. No. 3,980,410, the snowplowable marker has a downwardly extending tab at each of the four corners of the snowplowable frame which are input into corresponding holes filled with adhesive. U.S. Pat. Nos. 4,195,945; 4,147,447; and 3,587,416 disclose reflective snowplowable road markers that have generally square central members which have the reflectors disposed thereon, and elongated side members attached to the central members which have portions that rise above the top of the reflectors. These elongated side members also extend below the bottom of the central member. These markers are secured to the road surface by cutting a dished-out groove with deeper elongated grooves adjacent to the edges of the dished-out groove. This area cut into the road material is then filled with adhesive and the marker is placed in it. This method is shown and described in the brochure entitled, "STIMSONITE® LIFE-LITE 96 PLOWABLE PAVEMENT MARKER."

The prior art also discloses road reflectors which have other than tabs or elongated side members that extend down into the road material. U.S. Pat. No. 4,402,628 discloses a snowplowable road marker with recessed reflectors that has a cylinder shape and secured in a core cut into the road surface by adhesive. U.S. Pat. No. 4,155,666 discloses a cylindrical shaped snowplowable road marker having recessed reflectors that is secured in either an annular recess or core cut in the road surface by adhesive. Also, at least one embodiment discloses that the marker is supported at the surface of the roadway by tabs extending from the body of the apparatus to maintain the marker in its proper position at the surface of the road while the adhesive sets up and dries. U.S. Pat. No. 3,516,337 discloses a cylindrical road marker having a tapered shaft that extend from the bottom of the marker. The shaft has projections on its outside surface. The top portion of the marker is secured to the road surface by adhesive. This shaft is secured to the road material by adhesive disposed in the hole in which the shaft is disposed. U.S. Pat. No. 2,260,498 (also U.S. Pat. No. Des. 113,298) discloses a roadway marker that has a bottom member which extends into the road material. This bottom member has a cylindrical shape with a fillet between it and the bottom surface of the top of the marker. The marker also has ribs which extend perpendicularly outward from the bottom edge of the bottom member. The marker is apparently disposed in the road material as the road is laid and not after it is laid. These markers would be extremely difficult to install.

U.S. Pat. Nos. Des. 270,143, Des. 266,554 and Des. 266,060 show other snowplowable road markers which have their downwardly extending portion secured to the road surface by adhesive.

U.S. Pat. Nos. 4,088,416 discloses a road marker that is secured to the road surface by nails or spikes.

All of the above cited prior art references have except for U.S. Pat. No. 2,260,498 (also U.S. Pat. No. Des. 113,298) and 4,088,416 have the inherent problem of requiring the use of adhesive to secure the marker to the road. These road markers cannot be installed in winter because the adhesive will not set up and dry in such cold conditions. Additionally, whenever the markers are installed, even in the correct climatic conditions, there is always a set-up and drying time for the adhesive to secure the marker in the road before normal vehicular traffic can travel over the marker.

None of the prior art markers disclosed in the prior art can be easily disposed in a core or recessed annular opening cut in the road material without the use of an adhesive to secure the marker to the road material. Further, in those apparatus that do not require the use of adhesive, as in the case of U.S. Pat. Nos. 2,260,498 (also U.S. Pat. No. Des. 113,198) and 4,088,416, the road material must either be poured around the marker or spikes driven in the road material, which is both undesirable and inefficient for installation of road markers in all seasons.

The present invention overcomes these problems and provides a snowplowable road marker which is self-securing, quick and easy to install and virtually unremovable shortly after it is installed in the road surface.

DISCLOSURE OF INVENTION

The present invention is a reflective snowplowable road marker which is self-securing in a recessed annular opening or core cut in a road surface.

The present invention is a road marker of unitary construction that has a top and bottom section. However, the inventor contemplates that the top and bottom sections can be formed separately by any conventional means and later joined to form the road marker of the invention.

The snowplowable road marker of the invention has a circular shaped top section with a substantially planar bottom surface and an outwardly dished top surface that dishes outwardly from its peripheral edge. The outwardly dished top surface has a relatively wide relieved elongated channel diametrically disposed across it. The elongated channel is equidistantly disposed about a diametrically disposed line through the center point of the top section. Disposed transverse to the relieved elongated channel is a recessed rectangular groove. This groove is disposed across the channel at the center. The recessed groove is adapted to receive a reflector therein. The reflector has a height such that when it is disposed in the recessed rectangular groove, it will not extend above the height of the side walls of the relieved elongated channel.

The bottom section of the road marker of the invention is a hollow cylindrical member having a diameter less than the diameter of the top section. Because of the difference in the diameter of the top and bottom sections an annular flange is formed by the bottom surface of the top section that extends radially outward from the top edge of the bottom section.

The outside surface of the hollow cylindrical bottom section has a plurality of vertically disposed gripping members disposed thereon. Each of the gripping members is a column of upwardly directed serrations.

An object of the invention is to provide a reflective snowplowable road marker of unitary construction having a circular shaped top section that has an outwardly dished top surface with a relieved elongated channel diametrically disposed across it and a transversely disposed recessed rectangular groove across the channel, and a hollow cylindrically shaped bottom section having diameter less than the diameter of the top member with a plurality of columns of upwardly directed serrations disposed on the outside surface of the bottom section.

Another object of the invention is to provide a reflective snowplowable road marker that can be installed in a recessed annular opening or a core cut in the road surface.

A still further object of the invention is to provide a self-supporting reflective snowplowable road marker which can be installed in a road surface without the use of adhesive.

These and further objects of the invention will be described in the remaining portions of the disclosure.

BEST MODE FOR CARRYING OUT THE INVENTION

The present invention is a reflective snowplowable road marker. The snowplowable road marker of the invention is preferably of unitary construction and made of cast iron. Although the road marker of the invention is preferably made of cast iron, it can be constructed of any other material suitable for carrying out the objects of the invention. Further, the inventor contemplates that the apparatus does not have to be cast but can be formed from a sheet of heavy gauge metallic material by any conventional means. Further, the top and bottom sections of the road marker of the invention can be formed individually and later joined to form the road marker of the invention.

The reflective snowplowable road marker of the invention has a form such that a snowplow blade will ride up and over the marker without damaging it. The reflective lens of the road marker is recessed in a channel in the marker, as will be described subsequently, so that as the snowplow blade rides up and over the marker it will not be damaged or broken by the blade.

Referring to FIGS. 1, 2, 3 and 4, the preferred embodiment of the reflective snowplowable road marker of the invention will be described.

Figure 1:
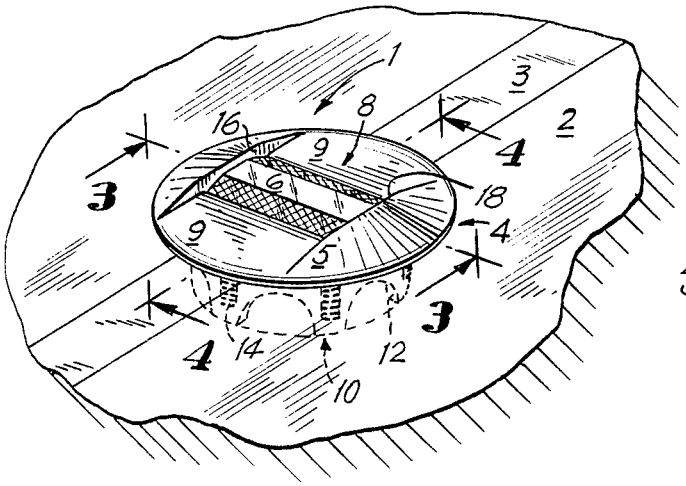
FIG. 1 shows a top perspective view of the apparatus of the invention disposed in a road.
Figure 2:
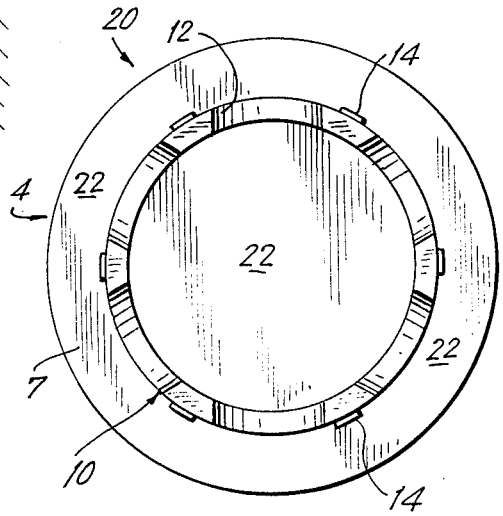
FIG. 2 shows a bottom view of the apparatus of the invention.
Figure 3:
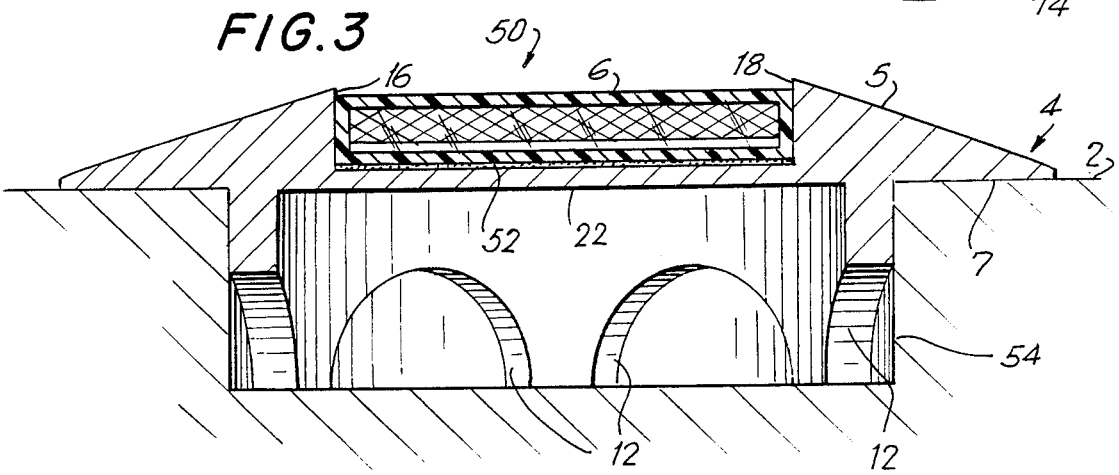
FIG. 3 shows a first cross-sectional view of the apparatus of the invention at 3—3 of FIG. 1.
Figure 4:
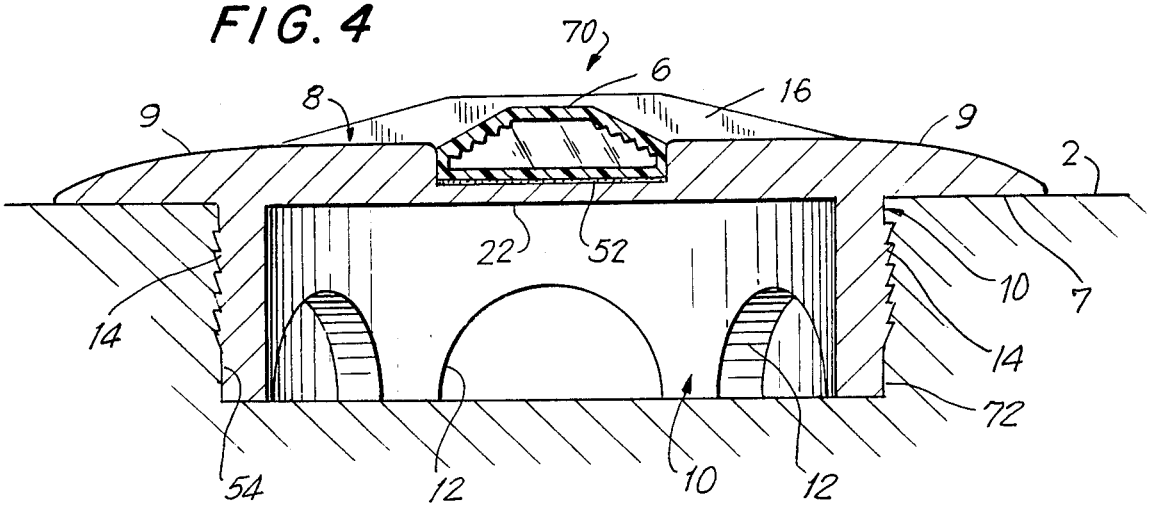
FIG. 4 shows a second cross-sectional view of the apparatus of the invention at 4—4 of FIG. 1.

The reflective snowplowable road marker shown generally at 1 in FIG. 1; generally at 20 in FIG. 2; generally at 50 in FIG. 3; and generally at 70 in FIG. 4, is usually disposed in the road surface at the white or yellow centerline 3 of road 2.

The snowplowable road marker of the invention is comprised of two sections, top section 4 and bottom section 10. Top section 4, as shown in FIG. 1, is circular shaped. Although it is preferably circular shaped, it is contemplated by the inventor that it can have other shapes, e.g. rectangular. Top section 4 has a substantially planar bottom surface 22. Top surface 5 of top section 4 is outwardly dished from its peripheral edge. The amount of outward dishing of top surface 5 of top section 4, is enough so that when the reflector 6 is disposed in recessed rectangular groove 52 of relieved elongated channel 8, side walls 16 and 18 of the elongated channel extend above the top of reflector 6. With walls 16 and 18 extending above the top of reflector 6, it is protected from damage when the snowplow blade passes up and over the road marker of the invention.

The outwardly dished top surface 5 of top section 4, as stated, has a relieved elongated channel 8 extending diametrically across the top member. Elongated channel 8 has bottom surface 9 with side walls 16 and 18 rising therefrom. The relieved elongated channel is equidistantly disposed about a diametrically disposed line extending across top section 4 through the center point of the top section. Disposed transversely across relieved elongated channel 8 is recessed rectangular groove 52. Recessed rectangular groove 52 is disposed across elongated channel 8 at its center where side walls 16 and 18 have their greatest height. Recessed rectangular groove 52 is adapted to receive therein reflector 6, as will be described subsequently.

Reflector 6 is generally mounted in recessed rectangular groove 52 and secured in the groove with a strong, durable, all weather adhesive. However, if the reflector is damaged it can be easily replaced by popping it out of groove 52 with an implement, such as a screwdriver, and a new reflector is secured in its place with adhesive. Reflector 6 can be any conventional type retroreflector or regular reflector that is either unidirectional or bidirectional. However, preferably reflector 6 is a bidirectional retroreflector as shown in FIGS. 1, 3 and 4. Reflector 6 also can be any type of indicator means that will indicate the position of the road marker. Therefore, it does not necessarily have to be a reflector to be still within the scope of the invention. Reflector 6 preferably extends the full length of groove 52 to provide the maximum amount of reflective surface for the road marker. Reflector 6 has a height such that after it is secured in recessed rectangular groove 52, its top edge will not extend higher than the height of side walls 16 and 18 of elongated channel 8. However, this upward extension of the reflector is enough to carry out the proper retroreflection of head light beams of automobiles traveling on the roadway employing the road marker of the invention.

The second section of the reflective snowplowable road marker of the invention, as previously described, is bottom section 10. Bottom section 10 is hollow and has a generally cylindrical shape. The diameter of the bottom section 10 is less than the diameter of top section 4. Since there is a difference in the diameters of the top and bottom sections, bottom surface 22 of top section 4 forms annular flange 7 that extends perpendicularly to and radially outward from the top edge of bottom section 10. The primary function of annular flange 7 will be described subsequently.

Disposed in the bottom edge of the cylindrically shaped bottom section 10 are a plurality of spaced apart upwardly extending semi-circular cut-outs 12. These cut-outs are made in the bottom edge of cylindrically shaped bottom section 10 to decrease the amount of material necessary for construction of the road marker of the invention. However, it is contemplated by the inventor that these cut-outs are not required, and the road marker of the invention can be constructed without the plurality of cut-outs 12. Although the preferred shape of cut-outs 12 are semi-circular, the inventor contemplates that other shapes of the cut-outs can be used without affecting the scope of the invention.

Disposed on the outside surface of cylindrically shaped bottom section 10 are a plurality of gripping members 14. Each gripping member 14 comprises a plurality of upwardly directed serrations disposed in a vertical column. Although preferably a column of upwardly directed serration are used as gripping members, other structures can be used as gripping members. Further, even if serrations are used, they can be disposed in other than in vertical columns as shown in FIGS. 1, 2 and 4, e.g., the serrations are singularly disposed in a random pattern about the outside surface of section 10, or in specific patterns other than in vertical columns on the outside surface of section 10. The interaction of the gripping members and the road material will be described subsequently.

The bottom of the outside surface of cylindrical bottom section 10 at 72 is tapered slightly inwardly. This taper in the bottom of the outside surface is to assist in installing the road marker of the invention.

The installation of the reflective snowplowable road marker of the invention will now be described.

When it is desired to install the road marker of the invention, first, a recessed annular opening or core is cut in the road material down to a predetermined depth. The predetermined depth of the cut for the recessed annular opening or core is at least as deep as the depth that cylindrical bottom section 10 extends below bottom surface 22 of top section 4. If, in fact, the recessed annular opening or core is cut at depths greater than the depth of the cylindrical bottom section extends below the top section, it will not affect the installation of the snowplowable road marker of the invention.

When the recessed annular opening is used for installation of the road marker of the invention, the road marker is supported in two positions. The first position of support is found where the portion of road material extends inside the hollow cylindrical bottom section 10 and contacts bottom surface 22 of the top section. The second position of the support is found where annular flange 7 contacts the surface of road 2.

When the snowplowable road marker of the invention is installed in a core cut in the road material, the road marker is supported in only one position. In this type of installation, the marker is only supported by annular flange 7 which contacts the surface of road 2. In either situation the road marker is more than adequately supported, but the preferred opening in the road material used for installation of the reflective snowplowable road marker of the invention is the recessed annular opening which is cut in the road surface by any conventional means.

When the recessed annular opening is used for installation of the road marker of the invention. the opening is cut having width that is slightly greater than the thickness of the bottom section 10 from its inside diameter to its outside diameter including the outward extension of serrations 14. The recessed annular opening is cut to a depth at least as deep as the depth cylindrical bottom section 10 extends below bottom surface 22 of top section 4. After the recessed annular opening is cut, the road marker of the invention is properly aligned with the roadway, and dropped or easily pressed into the recessed annular opening. Once the road marker of the invention is pressed or dropped into place, there is no need for further maintenance of the marker. Since no adhesives are used to secure the marker to the road material, there is no set-up or drying time required during which normal traffic must be diverted from contacting the reflective snowplowable road marker of the invention. In fact, as soon as it is pressed into place normal traffic can be resumed on the road employing the road marker of the invention.

When the second method of the installation is carried out, a core is cut in the road material which has a diameter slightly greater than the diameter of hollow cylindrical section 10 including twice the distance the serrations extend outwardly from the outside surface of bottom section 10. After the core is cut in the road material, the reflective snowplowable road marker of the invention is aligned with the roadway, and dropped or easily pressed into the core cut in the road material. Again, as in the preferred method of installation, normal traffic can be resumed on the roadway employing the reflective snowplowable road markers of the invention immediately after installation because no adhesive is needed to secure the road markers to the road material.

Approximately one day after the reflective snowplowable road marker of the invention is installed in either a recessed annular opening or a core cut in the road material, the road material will move in against the serrations and the outside surface of bottom section 10. The road material will move against the outside surface of the bottom section due to movement of the road itself which tends to close the opening. Passing vehicles also assist in moving the road material against the outside surface and serrations. Once the road material moves in against bottom member 10, the road marker of the invention is secured in place and virtually unremovable.

When the different methods of installation are used, different methods of securing the bottom section of the road marker to the road material are found. When the recessed annular opening is used, bottom section 10 is squeezed between the road material which moves against the outside surface and serrations of the bottom section, and the road material disposed inside the hollow cylindrical bottom section. When a core is used, the road marker of the invention is secured in place by the road material that moves against the outside surface and serrations of bottom section 10.

The terms and expressions which are employed here are used as terms of description and not of limitations. There is no intention, in the use of such terms and expressions of excluding the equivalence of the features shown, and described, it being recognized that various modifications are possible in the scope of the invention as claimed.

I claim:

1. A snowplowable road marker apparatus securable in a pre-formed opening in road material without the use of adhesive comprising:

an outwardly dished top section having a relieved elongated channel extending across said top section with said channel being adapted to receive therein an indicator means;

a bottom section with means connected to a bottom surface of said top section having a plurality of spaced apart gripping means disposed on an outside surface of said bottom section with said bottom section being adapted to be fixably disposed in road material of a road; and said indicator means with means connected to at least one surface of said channel for indicating the position of said marker apparatus.

2. The apparatus as recited in claim 1, wherein said channel has a recessed rectangular groove disposed transverse to and defined in said channel for receiving therein said indicator means.

3. The apparatus as recited in claim 1, wherein when said indicator means is disposed in said recessed rectangular groove its upward extension is substantially equal to or less than the height of first and second side walls of said relieved elongated channel.

4. The apparatus as recited in claim 3, wherein said indicator means includes a unidirectional reflector.

5. The apparatus as recited in claim 4, wherein said unidirectional reflector includes a unidirectional retroreflector.

6. The apparatus as recited in claim 3, wherein said indicator means includes a bidirectional reflector.

7. The apparatus as recited in claim 6, wherein said bidirectional reflector includes a bidirectional retroreflector.

8. The apparatus as recited in claim 1, wherein said bottom section includes a hollow cylindrical member having a top edge with means connected to a bottom surface of said top section.

9. The apparatus as recited in claim 8, wherein said top section is substantially circular in shape with a diameter greater than the diameter of said bottom section such that an annular flange is formed at the top edge of said bottom section by the bottom surface of said top section that extends radially outward from said top edge of said bottom section.

10. The apparatus as recited in claim 8, wherein a bottom edge of said hollow cylindrical bottom section has therein disposed a plurality of spaced apart upwardly extending semicircular cut-outs.

11. The apparatus as recited in claim 8, wherein said top section and said bottom section are formed as a single unit.

12. The apparatus as recited in claim 8, wherein said top section and said bottom section are formed as separate members that are fixably connected after being individually formed.

13. The apparatus as recited in claim 8, wherein each of said plurality of gripping means includes a plurality of upwardly directed serrations disposed in specific patterns on the outside surface of said bottom section.

14. The apparatus as recited in claim 13 wherein the pattern of each of said plurality of upwardly directed serrations includes serrations disposed in a vertical column.

15. The apparatus as recited in claim 13 wherein the pattern of each of said plurality of upwardly directed serrations includes serrations disposed in other than a vertical column.

16. A method for installing a road marker having a bottom section intended to extend into and be secured in road material of a road comprising the steps of:

cutting an opening in the road surface of a size and depth adapted to receive therein said bottom section of said road marker;

aligning the marker for the desired ultimate disposition of the marker in the road;

pressing said bottom section of said road marker into the opening cut in the road material; and securing the bottom section of said road marker in said opening without adhesive by said road material moving inwardly and engaging an outside surface of said bottom section.

17. the method as recited in claim 16, wherein the step of securing the bottom section further comprises engaging a plurality of gripping means disposed on the outside surface of the bottom section with said road material as said road material moves inwardly against said outside surface.

18. The method as recited in claim 16, wherein said cutting step further comprises cutting a recessed annular opening in said road material.

19. The method as recited in claim 16, wherein said cutting step further comprises cutting a core in said road material.

* * * * *